US009605531B2

(12) United States Patent
Xin et al.

(10) Patent No.: US 9,605,531 B2
(45) Date of Patent: Mar. 28, 2017

(54) INTELLIGENT TEST SYSTEM AND METHOD FOR MULTI-SEGMENT FRACTURED HORIZONTAL WELL

(71) Applicant: PetroChina Company Limited, Beijing (CN)

(72) Inventors: Hong Xin, Beijing (CN); Tianshou Zhu, Beijing (CN); Lijun Mu, Beijing (CN); Wei Huang, Beijing (CN); Ming Li, Beijing (CN); Qingming Gan, Beijing (CN); Haitao Yang, Beijing (CN); Lei Zhang, Beijing (CN); Ertao Han, Beijing (CN)

(73) Assignee: Petrochina Company Limited, Beijing (CN)

( * ) Notice: Subject to any disclaimer, the term of this patent is extended or adjusted under 35 U.S.C. 154(b) by 0 days.

(21) Appl. No.: 14/857,052

(22) Filed: Sep. 17, 2015

(65) Prior Publication Data

US 2016/0003031 A1 Jan. 7, 2016

Related U.S. Application Data

(63) Continuation of application No. PCT/CN2013/087675, filed on Nov. 22, 2013.

(51) Int. Cl.
*E21B 47/06* (2012.01)
*E21B 47/12* (2012.01)
(Continued)

(52) U.S. Cl.
CPC ..... *E21B 47/06* (2013.01); *E21B 33/124* (2013.01); *E21B 43/121* (2013.01); *E21B 43/14* (2013.01);
(Continued)

(58) Field of Classification Search
CPC ..... E21B 43/26; E21B 49/087; E21B 47/06; E21B 33/124; E21B 43/14; E21B 43/121; E21B 47/124; E21B 47/12
See application file for complete search history.

(56) References Cited

U.S. PATENT DOCUMENTS 6,279,660 B1 * 8/2001 Hay ..... E21B 17/206 166/336
2003/0066640 A1 * 4/2003 Perkins ..... E21B 33/124 166/162
(Continued)

FOREIGN PATENT DOCUMENTS

CN 201412133 Y 2/2010
CN 201802376 U 4/2011
(Continued)

OTHER PUBLICATIONS

State Intellectual Property Office of the P.R. China, International Search Report issued in corresponding International Application No. PCT/CN2013/087675, Aug. 20, 2014, 6 pp.
(Continued)

*Primary Examiner* — Yong-Suk (Philip) Ro
(74) *Attorney, Agent, or Firm* — Fitch, Even, Tabin & Flannery LLP

(57) ABSTRACT

An intelligent test system and a method for a multi-segment fractured horizontal well. The intelligent test method for a multi-segment fractured horizontal well comprises: step A: placing a test tubular column into an underground horizontal section; step B: setting a pressure building packer and a hanging packer by means of pressurization after the test tubular column is placed into an underground designed position; step C: breaking a hydraulic release connector to separate the hydraulic release connector from a seal pipe; step D: pulling out a first oil pipe, and reserving the tubular column comprising the seal pipe and located on the down-
(Continued)

stream part of the seal pipe in a horizontal well; and step E: placing a production tubular column or a communications tubular column into a vertical section of the horizontal well.

10 Claims, 3 Drawing Sheets

(51) Int. Cl.
*E21B 33/124* (2006.01)
*E21B 43/12* (2006.01)
*E21B 43/14* (2006.01)
*E21B 49/08* (2006.01)

(52) U.S. Cl.
CPC ..... *E21B 47/12* (2013.01); *E21B 47/124* (2013.01); *E21B 49/087* (2013.01)

(56) References Cited

U.S. PATENT DOCUMENTS

2003/0121663 A1* 7/2003 Weng ..... E21B 43/26 166/308.1
2011/0284214 A1* 11/2011 Ayoub ..... E21B 43/26 166/177.5
2012/0073819 A1* 3/2012 Richard ..... E21B 33/10 166/308.1
2012/0205120 A1 8/2012 Howell
2015/0354334 A1* 12/2015 Richard ..... E21B 33/124 166/298

FOREIGN PATENT DOCUMENTS

| | | | |
|---|---|---|---|
| CN | 202215223 | U | 5/2012 |
| CN | 102747967 | A | 10/2012 |
| CN | 102808584 | A | 12/2012 |
| CN | 202788638 | U | 3/2013 |
| CN | 203230415 | U | 10/2013 |
| CN | 203321507 | U | 12/2013 |
| EP | 2636844 | A2 | 9/2013 |

OTHER PUBLICATIONS

State Intellectual Property Office of China, Search Report issued in Chinese Patent Application No. 201310597516.4, Aug. 11, 2015, 4 pp.
Zhang et al., Lijuan, "Development and Application of the Compression Open Hole Packer", China Petroleum Machinery, vol. 40, Issue 12, Jun. 5, 2012, 4 pp.
State Intellectual Property Office of China, First Notification of Office Action issued in Chinese Application No. 201310597516.4, Aug. 11, 2015, 7 pp.

* cited by examiner

INTELLIGENT TEST SYSTEM AND METHOD FOR MULTI-SEGMENT FRACTURED HORIZONTAL WELL

CROSS-REFERENCE TO RELATED APPLICATION

This application is a continuation of International Application No. PCT/CN2013/087675, filed on Nov. 22, 2013, which is hereby incorporated by reference in its entirety.

TECHNICAL FIELD

The present disclosure relates to the field of oil production, in particular relates to an intelligent test system and method for a multi-segment fractured horizontal well for an oil field employed in the producing process of the horizontal well of the oil field, which collects data of the pressure, temperature and water content of each section, and performs ground detection, pressure build-up well testing and intelligent water plugging, i.e., an intelligent test system and method for a multi-segment fractured horizontal well.

BACKGROUND

At present, every large oil field vigorously promotes the mining technology for horizontal wells by focusing on improving the reservoir utilization, improving the recovery, improving single well output, and reducing the mining cost. However, since the trajectory of the borehole and the well pattern for injection production is complex and changeable, and the reservoir lithology, physical properties and reservoir fluid properties of each oil layer also differ from each other, each layer section of the horizontal well is different in the water absorption capacity, water line speed, and liquid production, resulting in that some layer sections of the horizontal well has earlier water breakthrough, and the position and direction of the water breakthrough, and the productivity and pressure condition of each layer section is not clear. At present, since the test technology for horizontal well is not mature enough, in particular, the test technology of horizontal well of low permeability reservoir which has low liquid level is still in the stage of exploration, resulting in that measurement for dynamic adjustment in site is pointless, and seriously affects the horizontal well development effect.

Thus, the operation of horizontal wells generally requires three stages, namely, testing, communicating and producing. During the testing process, a test tubular column needs to be placed to obtain the testing data; when transmitting the testing data from underground, a communication tubular column needs to be placed, and when performing ordinary production, the test tubular column needs to be pulled out and then a production tubular is placed.

SUMMARY

According to the present disclosure, an intelligent test method for a multi-segment fractured horizontal well is provided, in which a test tubular column is used, the test tubular column comprising:

a first oil pipe extending from a well head of the horizontal well into a vertical section of the well;

a hydraulic release connector arranged on a bottom end of the first oil pipe and located in the vertical section of the horizontal well;

a seal pipe connected to a lower end of the hydraulic release connector and located in the vertical section of the horizontal well, with a distance between a top end of the seal pipe and the well head of the horizontal well being greater than a working depth of a oil sucking pump being placed;

a hanging packer connected below the seal pipe;

a data collection controller connected below the hanging packer and located in the vertical section of the horizontal well;

a second oil pipe connected below the data collection controller and extending into a horizontal section of the horizontal well;

a cable extending to the horizontal section of the horizontal well from the data collection controller along an outer side of the second oil pipe;

a plurality of pressure building packers successively sheathed on the second oil pipe and located on the downstream part of the data collection controller, and a plurality of sealed spaces formed between the plurality of pressure building packers and between the hanging packer and the pressure building packer adjacent to the hanging packer;

a separate test controller arranged in each of the sealed spaces, wherein the separate test controller most proximate to the well head is located on the downstream part of the data collection controller; and wherein each of the separate test controllers is connected to the data collection controller in a manner of cable connection, and transmits the testing data to the data collection controller via the cable, and each of the separate test controllers receives a control instruction issued from the data collection controller through the cable;

the intelligent test method for a multi-segment fractured horizontal well comprising:

step A: placing the test tubular column into an underground horizontal section;

step B: setting a pressure building packer and a hanging packer setting by means of pressurization after the test tubular column is placed into an underground designed position;

step C: breaking a hydraulic release connector to separate the hydraulic release connector from the seal pipe;

step D: pulling out the first oil pipe, and reserving the test tubular column comprising the seal pipe on the test tubular column and located on the downstream part of the seal pipe in the horizontal well;

step E: placing a production tubular column or a communications tubular column into a vertical section of the horizontal well;

wherein the production tubular column comprises: a third oil pipe, an oil sucking rod connected below the third oil pipe and an oil sucking pump connected to the oil sucking rod;

the communications tubular column comprises: a steel wire and a communication nipple connected below the steel wire, the communication nipple being connected to the data collection controller by means of wireless communication; and the oil sucking pump or the communication nipple are placed above the seal pipe.

DESCRIPTION OF THE REFERENCE SIGNS

Figure 1:
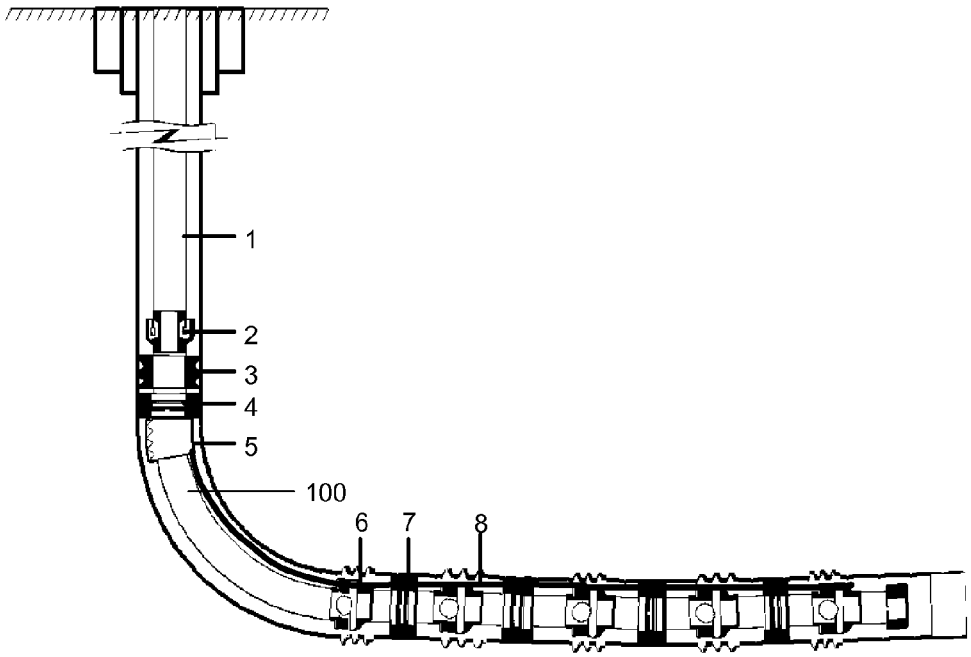
FIG. 1 is a diagram of the structure of the test tubular column of the embodiment of the present disclosure.

1—first oil pipe, 2—hydraulic release connector, 3—seal pipe, 4—hanging packer, 5—data collection controller, 6—separate test controller, 7—pressure building packers, 8—cable, 9—third oil pipe, 10—oil sucking rod, 11—oil sucking pump, 12—steel wire, 13—communication nipple, 100—second oil pipe

DESCRIPTION OF EMBODIMENTS

In the prior arts, different tubular columns need to be placed for different stages; and in each stage, the tubular column placed in the last stage shall be taken out before a new appointed tubular column is placed. In this way, there requires complex placing and pulling out of the tubular columns for each stage, causing a heavy workload, a long process and high cost.

According to the present disclosure, an intelligent test system and method for a multi-segment fractured horizontal well is provided, to solve the problem of connecting the test (or communication) and production processes during the production process of the horizontal well in a safe, efficient and quick manner.

According to the present disclosure, an intelligent test method for a multi-segment fractured horizontal well is provided, in which a test tubular column is used, the test tubular column comprising:

a first oil pipe extending from a well head of the horizontal well into a vertical section of the well;

a hydraulic release connector arranged on a bottom end of the first oil pipe and located in the vertical section of the horizontal well;

a seal pipe connected to a lower end of the hydraulic release connector and located in the vertical section of the horizontal well, with a distance between a top end of the seal pipe and the well head of the horizontal well being greater than a working depth of a oil sucking pump being placed;

a hanging packer connected below the seal pipe;

a data collection controller connected below the hanging packer and located in the vertical section of the horizontal well;

a second oil pipe connected below the data collection controller and extending into a horizontal section of the horizontal well;

a cable extending to the horizontal section of the horizontal well from the data collection controller along an outer side of the second oil pipe;

a plurality of pressure building packers successively sheathed on the second oil pipe and located on the downstream part of the data collection controller, and a plurality of sealed spaces formed between the plurality of pressure building packers and between the hanging packer and the pressure building packer adjacent to the hanging packer;

a separate test controller arranged in each of the sealed spaces, wherein the separate test controller most proximate to the well head is located on the downstream part of the data collection controller; and wherein each of the separate test controllers is connected to the data collection controller in a manner of cable connection, and transmits the testing data to the data collection controller via the cable, and each of the separate test controllers receives a control instruction issued from the data collection controller through the cable;

the intelligent test method for a multi-segment fractured horizontal well comprising:

step A: placing the test tubular column into an underground horizontal section;

step B: setting a pressure building packer and a hanging packer setting by means of pressurization after the test tubular column is placed into an underground designed position;

step C: breaking a hydraulic release connector to separate the hydraulic release connector from the seal pipe;

step D: pulling out the first oil pipe, and reserving the test tubular column comprising the seal pipe on the test tubular column and located on the downstream part of the seal pipe in the horizontal well;

step E: placing a production tubular column or a communications tubular column into a vertical section of the horizontal well;

wherein the production tubular column comprises: a third oil pipe, an oil sucking rod connected below the third oil pipe and an oil sucking pump connected to the oil sucking rod;

the communications tubular column comprises: a steel wire and a communication nipple connected below the steel wire, the communication nipple being connected to the data collection controller by means of wireless communication; and the oil sucking pump or the communication nipple are placed above the seal pipe.

In one embodiment, the step E is: placing the production tubular column into the vertical section of the horizontal well, and the intelligent test method for a multi-segment fractured horizontal well further comprises:

step F1: the oil sucking pump producing normally, meanwhile the separate test controller executing the test in accordance with a ground preset instruction, and each test result being directly uploaded to the data collection controller via the cable, to be stored;

step F2: pulling out the oil sucking pump, placing the communication nipple at the hydraulic release connector by using the steel wire, the communication nipple reading the data of the data collection controller by means of wireless communication, thereby making the communications tubular column obtain the data; or, the communication nipple transmitting relevant instructions to the data collection controller at the same time, and then the data collection controller issuing a control instruction to the separate test controller via the cable; and step F3: pulling out the communications tubular column and exporting data obtained by the communications tubular column.

In one embodiment, the step E is: placing the production tubular column into the vertical section of the horizontal well, and the intelligent test method for a multi-segment fractured horizontal well further comprises:

step F10: the oil sucking pump producing normally, meanwhile the separate test controller executing the test in accordance with a ground preset instruction, and each test result being directly uploaded to the data collection controller via the cable, the data collection controller analyzing and calculating the testing data by using a microprocessor, and transmitting via the cable a control instruction to the separate test controller in a layer section in which the water content exceeds a threshold;

step F20: each separate test controller being provided with a switch control of liquid inlet hole, closing the liquid inlet hole of the layer section in which the water content exceeds a threshold, thereby realizing water exploration of the horizontal well and the blocking of the corresponding layer section.

In one embodiment, the step E is: placing the communications tubular column into the vertical section of the horizontal well, and the intelligent test method for a multi-segment fractured horizontal well further comprises:

step F100: the communication nipple transmitting an instruction to the data collection controller by means of wireless communication, and controlling the separate test controller of each section, thereby realizing a shut-in pressure measurement;

step F200: each separate test controller testing pressure data of oil well, and uploading the data to the data collection controller via the cable, then the communication nipple reading the pressure data of oil well stored in the data collection controller to make the communications tubular column obtain the data; and step F300: pulling out the communications tubular column and exporting data obtained by the communications tubular column.

In one embodiment, the hanging packer is a Y445 hanging packer.

In one embodiment, the pressure building packer is a K344 packer, and the number of the pressure building packers is 8 to 10.

In one embodiment, the communication nipple and the data collection controller are separated by a distance of 10 m.

The present disclosure also provides an intelligent test system for a multi-segment fractured horizontal well, comprising: a test tubular column arranged in the horizontal well, the testing tubular column comprising:

a first oil pipe extending from the well head into a vertical section of the horizontal well;

a hydraulic release connector arranged on a bottom end of the first oil pipe and located in the vertical section of the horizontal well;

a seal pipe connected at a lower end of the hydraulic release connector and located in the vertical section of the horizontal well, with a distance between the top end of the seal pipe and the well head of the horizontal well being greater than a working depth of a oil sucking pump being placed;

a hanging packer connected below the seal pipe;

a data collection controller connected below the hanging packer and located in the vertical section of the horizontal well;

a second oil pipe connected below the data collection controller and extending into a horizontal section of the horizontal well;

a cable extending to the horizontal section of the horizontal well from the data collection controller along an outer side of the second oil pipe;

a plurality of pressure building packers successively sheathed on the second oil pipe and located on the downstream part of the data collection controller, and a plurality of sealed spaces formed between the plurality of pressure building packers and between the hanging packer and the pressure building packer adjacent to the hanging packer;

a separate test controller arranged in each of the sealed spaces, wherein the separate test controller most proximate to the well head is located on the downstream part of the data collection controller; and wherein each of the separate test controllers is connected to the data collection controller in a manner of cable connection, and transmits the testing data to the data collection controller via the cable, and each of the separate test controllers receives a control instruction issued from the data collection controller through the cable.

In one embodiment, the intelligent test system for a multi-segment fractured horizontal well further comprises: a production tubular column arranged in the horizontal well, the production tubular column comprising: a third oil pipe, an oil sucking rod connected below the third oil pipe, and an oil sucking pump connected to the oil sucking rod; a distance between the oil sucking pump and the well head of the horizontal well is less than a distance between the top end of the seal pipe and the well head of the horizontal well;

wherein, the test tubular column is in a state in which the hydraulic release connector breaks, the first oil pipe is pulled out, and the oil sucking pump is placed above the seal pipe.

In one embodiment, the intelligent test system for a multi-segment fractured horizontal well further comprises: a communications tubular column arranged in the horizontal well, the communications tubular column comprising: a steel wire and a communication nipple connected below the steel wire, the communication nipple being connected to the data collection controller by means of wireless communication;

wherein, the test tubular column is in a state in which the hydraulic release connector breaks, the first oil pipe is pulled out, and the communication nipple is placed at the hydraulic release connector.

In the present disclosure, the production tubular column, the communications tubular column and the test tubular column are arranged separately, and the data collection controller and each of the packers on the test tubular column are fixed in the horizontal well. These tubular columns form detachable connections with the first oil pipe in the vertical section of the horizontal well via the of hydraulic release connector. When a full set of test tubular column is placed, the first oil pipe is connected to the second oil pipe and the data collection controller thereon as well as each of the packers as one body. When there is a need to perform production or communication, the production or communication is performed by breaking the hydraulic release connector, pulling out the first oil pipe, retaining the tubular column comprising the seal pipe on the test tubular column and located on the downstream part of the seal pipe in the horizontal well, and then replacing the first oil pipe with the production tubular column and the communications tubular column. In this process, there is no need to take out the entire test tubular column as the production tubular column and the communications tubular column are placed, as in the prior art. Therefore, there is no need to pull out a full set of test tubular column, thus the workload of pulling and placing of the tubular column is greatly reduced, thereby improving the working efficiency.

Furthermore, when malfunction occurs in the oil sucking pump, there is no need to pull out the full set of tubular column, which greatly reduces the workload of pulling and placing of the tubular columns, and thus the present disclosure also achieves the effect of convenient maintenance and increased working time.

By combining the test tubular column, the production tubular column and the communications tubular column, the present disclosure can achieve a plurality of functions such as detecting the pressure, temperature and water content of each well section in the production process, performing water exploration of the horizontal well, blocking the corresponding layer sections, and performing shut-in well pressure measurement and pressure recovery, thereby reducing the workload of pulling and placing of the tubular column to the largest extent, reducing the test cost, providing reliable basic data for the study of oil reservoir of horizontal well, and improving the development effect of the horizontal well to the largest extent.

The present disclosure solves the problem of quick water exploration, and the set of test tubular column can also realize effective blocking of the water producing layer. The problem of testing the pressure, temperature and water content in the production process is solved, and by ingeniously applying the combination of several tubular columns to perform the testing and communication, the times of pulling out and placing drill have been largely reduced.

Now, the present disclosure is described with reference to the accompanying drawings in order to provide a more clear explanation to the technical features, objects and effects of the present disclosure.

As shown in FIG. 1, the intelligent test system for a multi-segment fractured horizontal well includes: a test tubular column arranged in the horizontal well, the test tubular column comprising:

a first oil pipe 1 extending into a vertical section of the horizontal well from a well head;

a hydraulic release connector 2 arranged on a bottom end of the first oil pipe 1 and located in the vertical section of the horizontal well;

a seal pipe 3 connected to a lower end of the hydraulic release connector 2 and located in the vertical section of the horizontal well, with a distance between a top end of the seal pipe 3 and the well head of the horizontal well being greater than a working depth of a oil sucking pump 11 being placed. That is, the seal pipe 3 shall be placed in a certain depth, such that the oil sucking pump 11 is located above the seal pipe 3 when operating;

wherein, the hydraulic release connector 2 is in a detachable connection with the seal pipe 3 or a second oil pipe 100;

a hanging packer 4 connected below the seal pipe 3, for example, the hanging packer 4 being Y445 hanging packer, which will not push upward or glide down, and is stable and reliable;

a data collection controller 5 connected below the hanging packer 4 and located in the vertical section of the horizontal well;

a second oil pipe 100 connected below the data collection controller 5 and extending into a horizontal section of the horizontal well;

a cable 8 extending from the data collection controller 5 into the horizontal section of the horizontal well along an outer side of the second oil pipe 100;

a plurality of pressure building packers 7 successively sheathed on the second oil pipe 100 and located on the downstream part of the data collection controller 5, and a plurality of sealed spaces formed between the plurality of pressure building packers 7 and between the hanging packer 4 and the pressure building packer 7 adjacent to the hanging packer 4; for example, the number of the pressure building packers being 8 to 10, and being capable of finishing a test for sections 8 to 10 of the horizontal well;

a separate test controller 6 arranged in each of the sealed spaces, wherein the separate test controller most proximate to the well head is located on the downstream part of the data collection controller 5; and wherein each of the separate test controllers 6 is connected to the data collection controller 5 via a cable 8 connection manner, and transmits the testing data to the data collection controller 5 via the cable, and each of the separate test controllers 6 receives a control instruction issued from the data collection controller 5 via the cable.

The data collection controller and each of the packers on the test tubular column are all fixed in the horizontal well, and these tubular columns form detachable connections with the first oil pipe in the vertical section of the horizontal well through the hydraulic release connector. When a full set of test tubular column is placed, the first oil pipe is connected to the second oil pipe and the data collection controller thereon as well as each of the packers as one body. When there is a need to perform production or communication, the production or communication is performed by breaking the hydraulic release connector, pulling out the first oil pipe, retaining the tubular column comprising the seal pipe on the test tubular column and located on the downstream part of the seal pipe in the horizontal well, and replacing the first oil pipe with the production tubular column and the communications tubular column. In this process, there is no need to take out the entire test tubular column as the production tubular column and the communications tubular column are placed, as that in the prior art. Therefore, there is no need to pull out a full set of test tubular column, thus the workload of pulling and placing of the tubular column is greatly reduced, thereby improving the working efficiency.

Figure 2:
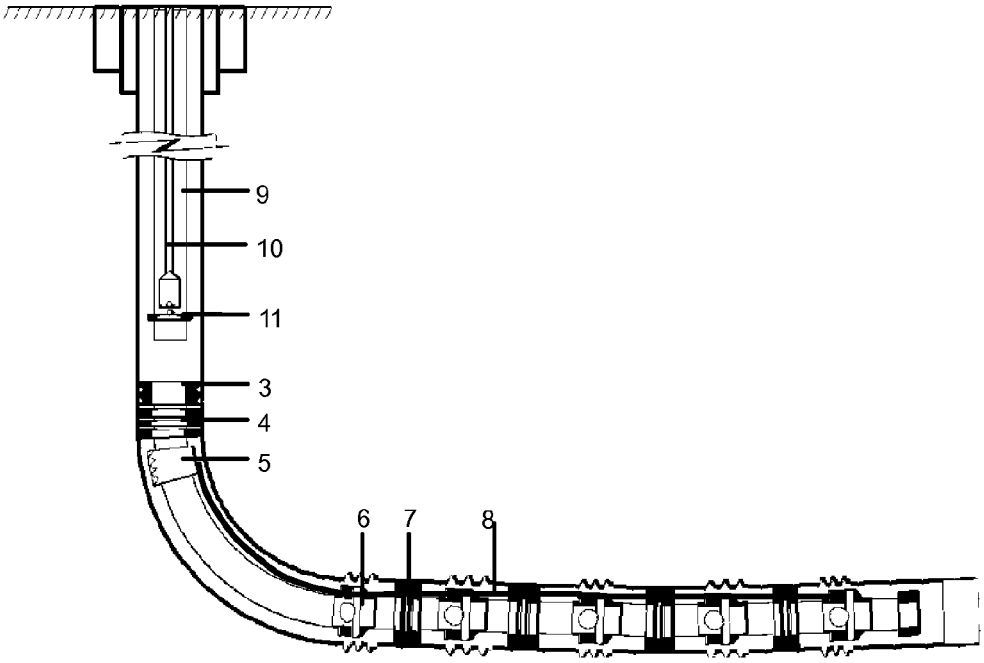
FIG. 2 is a diagram of the structure of the production tubular column of the embodiment of the present disclosure.

Further, as shown in FIG. 2, the intelligent test system for a multi-segment fractured horizontal well further comprises a production tubular column arranged in the horizontal well, the production tubular column comprising: a third oil pipe 9, a oil sucking rod 10 connected below the third oil pipe, and an oil sucking pump 11 connected to the oil sucking rod; a distance between the oil sucking pump 11 and the well head of the horizontal well is less than a distance between a top end of the seal pipe 3 and the well head of the horizontal well; in a state in which the production tubular column is placed, the test tubular column is in a state in which the hydraulic release connector breaks, the first oil pipe is pulled out, and the oil sucking pump is placed above the seal pipe.

That is to say, when the production tubular column is placed, there is no need to pull out or place down the components located under the seal pipe 3 on the test tubular column, but only need to pull out and place down the first oil pipe 1 and the hydraulic release connector 2. Besides, after the oil sucking pump 11 is placed into the well, it should be ensured that the oil sucking pump 11 will not contradict with the seal pipe 3 or the components located under the seal pipe 3 on the test tubular column or the test tubular column that pulls out or places down the hydraulic release connector, that is, to ensure that after the oil sucking pump 11 is placed into the well, the oil sucking pump 11 is kept in a certain distance from the seal pipe 3 or the test tubular column that pulls out or places down the hydraulic release connector.

Figure 3:
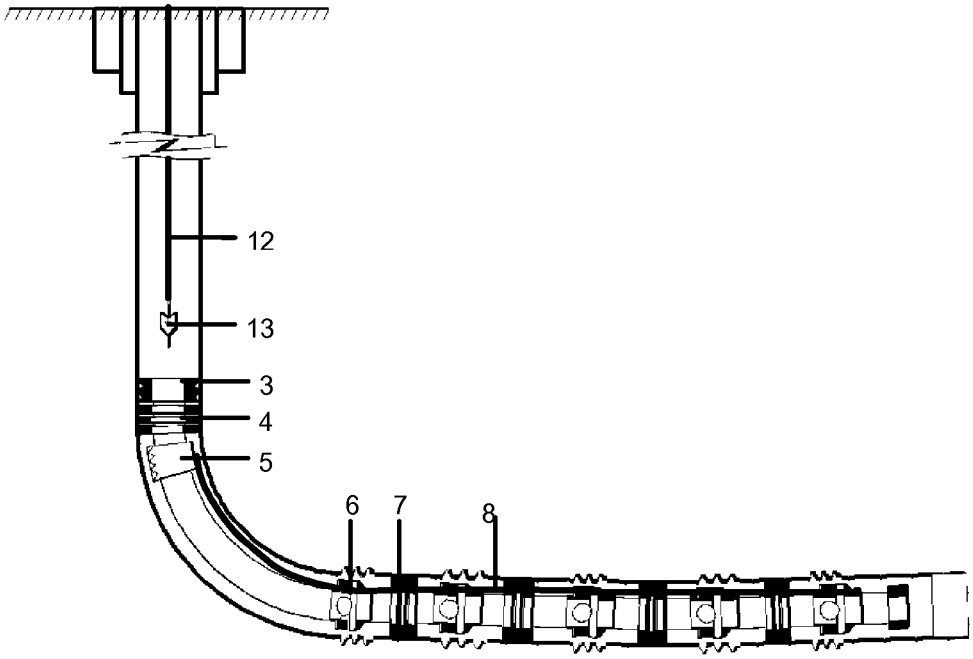
FIG. 3 is a diagram of the structure of the communications tubular column of the embodiment of the present disclosure.

Further, as shown in FIG. 3, the intelligent test system for a multi-segment fractured horizontal well further comprises a communications tubular column arranged in the horizontal well, the communications tubular column comprising: a steel wire 12 and a communication nipple 13 connected below the steel wire, the communication nipple 13 being connected to the data collection controller 5 by means of wireless communication; wherein, the test tubular column is in a state in which the hydraulic release connector breaks, the first oil pipe is pulled out, and the communication nipple is placed at the hydraulic release connector.

When the communications tubular column is placed, there is no need to pull out or place down the components located under the seal pipe 3 on the test tubular column, but only need to pull out and place down the first oil pipe 1 and the hydraulic release connector 2. Besides, after the communication nipple 13 is placed into the well, it should be ensured that the communication nipple 13 will not contradict with the seal pipe 3 or the components located under the seal pipe 3 on the test tubular column or the test tubular column that pulls out or places down the hydraulic release connector, that is, to ensure that after the communication nipple 13 is placed into the well, the communication nipple 13 is kept in a certain distance from the seal pipe 3 or the test tubular column that pulls out or places down the hydraulic release connector. For example, the communication nipple and the data collection controller are separated by a distance of 10 m, so as to obtain a better effect of wireless communication.

The present disclosure relates to an intelligent test method for a multi-segment fractured horizontal well, comprising:

step A: as shown in FIG. 1, placing the test tubular column into an underground horizontal section;

step B: setting a pressure building packer and a hanging packer setting by means of pressurization after the test tubular column is placed into an underground designed position, for example, through pressurization of oil pipe, the pressure difference between inside and outside of the oil pipe reaching the setting pressure of the packers;

step C: then, as shown in FIG. 2 or 3, breaking the hydraulic release connector 2 to separate the hydraulic release connector 2 from a seal pipe 3, wherein the full set of test tubular columns are broken into two parts at the hydraulic release connector, the first part being: the first oil pipe 1 and the hydraulic release connector 2 connected thereto, and the second part being: the full set of test tubular column after the first part is removed therefrom, or, the second part being: the seal pipe, the hanging packer, the second oil pipe, the data collection controller, the cable, the plurality of pressure building packers and the separate test controller that are connected together;

step D: pulling out the first oil pipe 1, connecting the hydraulic release connector 2 to the first oil pipe 1, whereby the hydraulic release connector 2 is pulled out together, and reserving the tubular column comprising the seal pipe on the test tubular column and located on the downstream part of the seal pipe in a horizontal well; that is to say, the first part of the test tubular column being taken out from underground while the second part of the test tubular column is remained underground without being taken out, the second part of the test tubular column directly matching with the production tubular column and communications tubular column placed subsequently; and step E: placing the production tubular column or communications tubular column into the vertical section of the horizontal well. In the present disclosure, there are situations where the test tubular column is used in cooperation with the production tubular column, and where the test tubular column is used in cooperation with the communications tubular column. The two situations can respectively achieve a plurality of functions such as testing the data such as pressure, temperature and water content of each well section in the producing process, performing water exploration of the horizontal well, blocking the corresponding layer section, and performing shut-in well pressure measurement and pressure recovery.

For example, the method of testing the data such as pressure, temperature and water content of each well section during the producing process is:

after placing the test tubular column to the designed position, when the pressure difference between inside and outside of the oil pipe reaches the setting pressure of each of the packers, setting the Y445 and K344 packers by means of pressurization of oil pipe, and breaking the hydraulic release connector;

pulling out the first oil pipe 1;

placing the production tubular column into the vertical section of the horizontal well, and the intelligent test method for a multi-segment fractured horizontal well further comprising:

step F1: the oil sucking pump or the oil well producing normally, meanwhile the separate test controller executing the test in accordance with a ground preset instruction, each test results being directly uploaded to the data collection controller via the cable, to be stored;

step F2: when there is a need of performing data reclamation, pulling out the oil sucking pump, placing the communication nipple to the hydraulic release connector by using a steel wire, the communication nipple reads data of the data collection controller by means of wireless communication to make the communications tubular column obtain the data; or, the communication nipple transmitting relevant instructions to the data collection controller at the same time, and the data collection controller issuing a control instruction to the separate test controller via the cable;

step F3: pulling out the communications tubular column, exporting the data obtained by the communications tubular column, thereby obtaining the data of the pressure, temperature and water content of each well section in the production process.

For example, the water plugging method is:

after placing the test tubular column into the designed position, when the pressure difference between inside and outside of the oil pipe reaches the setting pressure of each of the packers through pressurization of oil pipe, setting the Y445 and K344 packers, and breaking the hydraulic release connector;

pulling out the first oil pipe 1;

placing the production tubular column into the vertical section of the horizontal well, the intelligent test method for a multi-segment fractured horizontal well further comprising:

step F10: the oil sucking pump or the oil well producing normally, meanwhile the separate test controller executing the test in accordance with the ground preset instruction, each test result being uploaded to the data collection controller via the cable, the data collection controller analyzing and calculating the test data by using a microprocessor of itself, and transmitting via the cable a control instruction to the separate test controller in a layer section in which the water content exceeds a threshold;

step F20: each separate test controller being provided with a switch control of liquid inlet hole, closing the liquid inlet hole of the layer section in which the water content exceeds a threshold, thereby realizing water exploration of the horizontal well and the blocking of the corresponding layer section.

For example, the shut-in pressure measuring method is:

after placing the test tubular column into the designed position, when the pressure difference between inside and outside of the oil pipe reaches the setting pressure of each of the packers, setting the Y445 and K344 packers by means of pressurization of oil pipe, and breaking the hydraulic release connector;

pulling out the first oil pipe 1;

placing the communications tubular column into the vertical section of the horizontal well, and the intelligent test method for a multi-segment fractured horizontal well further comprises:

step F100: the communication nipple transmitting an instruction to the data collection controller by means of wireless communication, controlling the separate test controller of each layer section, and thereby realizing a shut-in pressure measurement;

step F200: each separate test controller testing oil well pressure, uploading the pressure data to the data collection controller via the cable, and the communication nipple reading the pressure data of oil well stored in the data collection controller to make the communications tubular column obtain the data;

step F300: pulling out the communications tubular column and exporting data obtained by the communications tubular column.

The present disclosure has the following technical effects:

(1) by combining the test tubular column and production tubular column, or by combining the test tubular column and the communications tubular column, the intelligent test system for a multi-segment fractured horizontal well can realize a plurality of functions such as testing the data of the pressure, temperature and water content of each well section in the production process, performing water exploration of the horizontal well, blocking the corresponding layer section, and performing shut-in well pressure measurement and pressure recovery, thereby reducing the workload of pulling and placing of the tubular column to the largest extent, reducing the test cost, providing the reliable basic data for the study of oil reservoir of horizontal well, and improving the development effect of the horizontal well to the largest extent.

(2) the test tubular column is fixed by using a hanging packer, so that it would not push upward and slide down, but is stable and reliable.

(3) the production tubular column is separated from the test tubular column, so that when a malfunction occurs in the pipe pump or the oil sucking pump, and there is no need to pull out the full set of production tubular column, whereby the workload of pulling and placing of the tubular column is greatly reduced.

(4) the K344 packer is released through annulus pressure, whereby the tests of sections 8-10 of the horizontal sections can be ensured.

The above are only the exemplary specific embodiments of the present disclosure, and are not used for limiting the scope of the present disclosure. Each of the constituent parts of the present disclosure can be combined with each other in a non-conflict condition, any equivalent variations and amendments made by those skilled in the art without departing from the concept and principles of the present disclosure should be included in the protection scope of the present disclosure.

What is claimed is:

1. An intelligent test method for a multi-segment fractured horizontal well, comprising:

providing a test tubular column, wherein the step of providing a test tubular column comprises:

providing a first oil pipe extending from a well head into a vertical section of the horizontal well;

providing a hydraulic release connector arranged at a bottom end of the first oil pipe and located in the vertical section of the horizontal well;

providing a seal pipe connected at a lower end of the hydraulic release connector and located in the vertical section of the horizontal well, with a distance between a top end of the seal pipe and the well head of the horizontal well being greater than a working depth of a oil sucking pump being placed;

providing a hanging packer connected below the seal pipe;

providing a data collection controller connected below the hanging packer and located in the vertical section of the horizontal well;

providing a second oil pipe connected below the data collection controller and extends into a horizontal section of the horizontal well;

providing a cable extending to the horizontal section of the horizontal well from the data collection controller along an outer side of the second oil pipe;

providing a plurality of pressure building packers successively sheathed on the second oil pipe and located on the downstream part of the data collection controller, and a plurality of sealed spaces formed between the plurality of pressure building packers and between the hanging packer and the pressure building packer adjacent to the hanging packer; and providing a separate test controller arranged in each of the sealed spaces, wherein the separate test controller most proximate to the well head is located on the downstream part of the data collection controller; and wherein each of the separate test controllers is connected to the data collection controller in a manner of cable connection, transmits a testing data to the data collection controller via the cable, and each of the separate test controllers receives a control instruction issued from the data collection controller via the cable;

setting the pressure building packer and the hanging packer by means of pressurization after the test tubular column is placed in an underground designed position;

breaking the hydraulic release connector to separate the hydraulic release connector from the seal pipe;

pulling out the first oil pipe, and reserving the tubular column comprising the seal pipe on the test tubular column and located on the downstream part of the seal pipe in the horizontal well;

placing a production tubular column or a communications tubular column into the vertical section of the horizontal well; wherein the production tubular column comprises: a third oil pipe, an oil sucking rod connected below the third oil pipe and an oil sucking pump connected to the oil sucking rod; wherein the communications tubular column comprises: a steel wire and a communication nipple connected below the steel wire, the communication nipple being connected to the data collection controller by means of wireless communication; and the oil sucking pump or the communication nipple is placed above the seal pipe.

2. The intelligent test method for a multi-segment fractured horizontal well according to claim 1, wherein when the step of placing a production tubular column or a communications tubular column into the vertical section of the horizontal well is: placing the production tubular column into the vertical section of the horizontal well, the intelligent test method for a multi-segment fractured horizontal well further comprises:

maintaining the oil sucking pump producing normally, meanwhile the separate test controller executing the test in accordance with a ground preset instruction, and each test results being directly uploaded via the cable to the data collection controller, to be stored;

pulling out the oil sucking pump, placing the communication nipple to the hydraulic release connector by using the steel wire; the communication nipple reading data of the data collection controller by means of wireless communication to make the communications tubular column obtain the data; or, the communication nipple transmitting relevant instructions to the data collection controller at the same time, and then the data collection controller issuing a control instruction to the separate test controller via the cable; and pulling out the communications tubular column and exporting the data obtained by the communications tubular column.

3. The intelligent test method for a multi-segment fractured horizontal well according to claim 1, wherein, when the step of placing a production tubular column or a communications tubular column into the vertical section of the horizontal well is: placing the production tubular column into a vertical section of the horizontal well, and the intelligent test method for a multi-segment fractured horizontal well further comprises:

maintining the oil sucking pump producing normally, meanwhile the separate test controller executing the test in accordance with a ground preset instruction, and directly uploading each test result to the data collection controller via the cable, wherein the data collection controller analyzing and calculating the testing data by using a microprocessor, and transmitting the control instruction via the cable to the separate test controller of the layer sections in which a water content exceeds a threshold; and wherein each of the separate test controllers being provided with a switch control of liquid inlet hole, closing the liquid inlet hole of the layer sections in which the water content exceeds the threshold, thereby realizing water exploration of the horizontal well and the blocking of the corresponding layer section.

4. The intelligent test method for a multi-segment fractured horizontal well according to claim 1, wherein, when the step of placing a production tubular column or a communications tubular column into the vertical section of the horizontal well is: placing the communications tubular column into the vertical section of the horizontal well, and the intelligent test method for a multi-segment fractured horizontal well further comprises:

having the communication nipple transmitting the instruction to the data collection controller by means of wireless communication, controlling the separate test controller of each of the layer sections, thereby realizing a shut-in pressure measurement;

having each of the separate test controllers testing a pressure date of the oil well, and uploading pressure data to the data collection controller via the cable, the communication nipple reading the pressure data of oil well stored in the data collection controller to make the communications tubular column obtain the data; and pulling out the communications tubular column and exporting the data obtained by the communications tubular column.

5. The intelligent test method for a multi-segment fractured horizontal well according to claim 1, wherein, the hanging packer is a hanging packer of Y445 type.

6. The intelligent test method for a multi-segment fractured horizontal well according to claim 1, wherein, the pressure building packer is a packer of K344 type, and the number of the pressure building packers is 8 to 10.

7. The intelligent test method for a multi-segment fractured horizontal well according to claim 1, wherein, the communication nipple and the data collection controller are separated by a distance of 10 meters.

8. An intelligent test system for a multi-segment fractured horizontal well, comprising a test tubular column arranged in the horizontal well, the test tubular column comprising:

a first oil pipe extending from a well head into a vertical section of the horizontal well;

a hydraulic release connector arranged at a bottom end of the first oil pipe and located in the vertical section of the horizontal well;

a seal pipe connected to a lower end of the hydraulic release connector and located in the vertical section of the horizontal well, with a distance between a top end of the seal pipe and the well head of the horizontal well being greater than a working depth of a oil sucking pump being placed;

a hanging packer connected below the seal pipe;

a data collection controller connected below the hanging packer and located in the vertical section of the horizontal well;

a second oil pipe connected below the data collection controller and extending into a horizontal section of the horizontal well;

a cable extending into the horizontal section of the horizontal well from the data collection controller along an outer side of the second oil pipe;

a plurality of pressure building packers successively sheathed on the second oil pipe and located on the downstream part of the data collection controller, and a plurality of sealed spaces formed between the plurality of pressure building packers and between the hanging packer and the pressure building packer adjacent to the hanging packer;

a separate test controller arranged in each of the sealed spaces, wherein the separate test controller most proximate to the well head is located on the downstream part of the data collection controller; and wherein each of the separate test controllers is connected to the data collection controller in a manner of cable connection, transmits a testing data to the data collection controller via the cable, and each of the separate test controllers receives a control instruction issued from the data collection controller via the cable.

9. The intelligent test system for a multi-segment fractured horizontal well according to claim 8, wherein, the intelligent test system for a multi-segment fractured horizontal well further comprises a production tubular column arranged in the horizontal well, the production tubular column comprising: a third oil pipe, an oil sucking rod connected below the third oil pipe, and an oil sucking pump connected to the oil sucking rod; a distance between the oil sucking pump and the well head of the horizontal well is less than a distance between the top end of the seal pipe and the well head of the horizontal well;

wherein, the test tubular column is in a state in which the hydraulic release connector breaks, the first oil pipe is pulled out, and the oil sucking pump is placed above the seal pipe.

10. The intelligent test system for a multi-segment fractured horizontal well according to claim 8, wherein, the intelligent test system for a multi-segment fractured horizontal well further comprises a communications tubular column arranged in the horizontal well, the communications tubular column comprising: a steel wire and a communication nipple connected below the steel wire, the communication nipple being connected to the data collection controller by means of wireless communication;

wherein, the test tubular column is in a state in which the hydraulic release connector breaks, the first oil pipe is pulled out, and the communication nipple is placed to the hydraulic release connector.

* * * * *